US007285029B1

(12) United States Patent
Janitz

(10) Patent No.: US 7,285,029 B1
(45) Date of Patent: Oct. 23, 2007

(54) SUPPORT DEVICE FOR A TROLLING MOTOR

(75) Inventor: Mikel E. Janitz, Tulsa, OK (US)

(73) Assignee: Brunswick Corporation, Lake Forest, IL (US)

( * ) Notice: Subject to any disclaimer, the term of this patent is extended or adjusted under 35 U.S.C. 154(b) by 17 days.

(21) Appl. No.: 11/269,115

(22) Filed: Nov. 8, 2005

(51) Int. Cl.
*B60L 11/00* (2006.01)

(52) U.S. Cl. ..... 440/6

(58) Field of Classification Search ..... 440/6, 440/8; 30/151
See application file for complete search history.

(56) References Cited

U.S. PATENT DOCUMENTS

| | | | | |
|---|---|---|---|---|
| 3,861,628 | A | 1/1975 | Krieger | 248/4 |
| 3,999,500 | A | 12/1976 | Friedel et al. | 115/17 |
| 4,008,680 | A | 2/1977 | Alexander, Jr. | 115/18 E |
| 4,819,905 | A | 4/1989 | McCain | 248/642 |
| 4,875,656 | A | 10/1989 | Boede | 248/642 |
| 5,002,509 | A | 3/1991 | Uroszek | 440/6 |
| 5,116,267 | A | 5/1992 | Olson | 440/56 |
| 5,340,077 | A | 8/1994 | Tyler | 248/642 |
| 6,224,437 | B1 | 5/2001 | Griffith et al. | 440/53 |
| 6,254,441 | B1 | 7/2001 | Knight et al. | 440/6 |
| 6,374,408 | B1 * | 4/2002 | Tomlinson et al. | 2/22 |
| 6,394,408 | B1 | 5/2002 | Henderson et al. | 248/640 |
| D461,480 | S | 8/2002 | Knight et al. | D15/4 |
| 6,808,431 | B1 | 10/2004 | Neely | 440/63 |

* cited by examiner

*Primary Examiner*—Stephen Avila
(74) *Attorney, Agent, or Firm*—William D. Lanyi

(57) ABSTRACT

A support device for a trolling motor is attachable to an arm of the trolling motor to provide a cushion between the arm and a deck surface of a boat. This cushion inhibits bouncing of the arm of the trolling motor in response to a boat traveling over rough water or being trailered from one location to another over roads. The support device is attachable to the arm of the trolling motor without additional fasteners, such as screws or clips. It is also movable to different positions along the length of the arm of the trolling motor, thus allowing more than one support device to be attached to the trolling motor mount.

16 Claims, 5 Drawing Sheets

SUPPORT DEVICE FOR A TROLLING MOTOR

BACKGROUND OF THE INVENTION

1. Field of the Invention

The present invention is generally related to a support device for a trolling motor and, more particularly, to a support device that can be easily attached to an extendable arm of a trolling motor to provide support between the arm and the deck of a boat when the trolling motor is in a retracted or stowed position.

2. Description of the Related Art

Many different types of trolling motor devices are well known to those skilled in the art. Typically, a trolling motor is configured so that it can easily be deployed for use and, alternatively, retracted for storage when not in use.

U.S. Pat. No. 3,861,628, which issued to Krieger on Jan. 21, 1975, describes a folding accessory bracket assembly that is particularly adapted for mounting a trolling motor so as to automatically position the accessory vertically in the water in an extended position and parallel to and on top of the boat deck in a retracted position. The bracket assembly generally comprises a mounting means attached to the boat deck and an accessory bracket for mounting to the accessory. Arm means are pivotally mounted between the mounting means and the accessory bracket for automatically positioning the accessory bracket as the arm means are pivoted, to thereby properly position the accessory in the extreme positions.

U.S. Pat. No. 3,999,500, which issued to Friedel et al. on Dec. 28, 1976, describes a pivotal support lock apparatus for trolling motor apparatus. The mount for a trolling motor includes a deck bracket having a housing arm pivotally mounted at one end. A gear mechanism within the arm has a fixed bevel gear on the pivot arm axis meshing with a bevel gear in a rotatable torque tube. A drive bevel gear is secured to the opposite end and meshes with a gear sector on a coupling head pivotally mounted in the outer end of the arm.

U.S. Pat. No. 4,008,680, which issued to Alexander on Feb. 22, 1977, discloses a pivotal mount assembly for trolling motors. The mount includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear sector on a coupling head pivotally mounted in the outer end of the arm. The head includes a swivel support within which a trolling motor unit is rotatably mounted.

U.S. Pat. No. 4,819,905, which issued to McCain on Apr. 11, 1989, describes a trolling motor mount for pleasure boats. An adjustable bracket mounting support for mounting an electric trolling motor on the forward end of a is pleasure boat is described. It includes a base member supported by two adjustable length arms which are attached to slidable clamps mounted on the bow rails of the boat and a downwardly extending support leg which attaches to the bow eye of the boat. A motor mount plate is rotatably mounted on the base plate and is adapted for receiving the mounting bracket assembly of a remotely controlled electric trolling motor.

U.S. Pat. No. 4,875,656, which issued to Boede on Oct. 24, 1989, discloses a stowable pull handle for electric trolling motor support apparatus. A manual operating cord for a deck-mounted electric trolling motor includes a handle which is demountably attachable to an arm of the pivotal motor support apparatus when the motor is in the operative or stowed position. The demountable handle assures that the operating cord will always be readily accessible to the operator in the boat to either raise the motor from its operative position or lower it thereto from its stowed position on the deck. The handle is demountably secured to one of the pivot arms of the motor support apparatus by frictional engagement between the legs of an elongated U-shaped slot in the handle and the lateral faces of the pivot arm.

U.S. Pat. No. 5,002,509, which issued to Uroszek on Mar. 26, 1991, describes a trolling motor mount. The mount is for use in mounting an outboard trolling motor on the outboard drive unit of a boat equipped with an inboard/outboard type power unit. The motor mount includes a mounting block for supporting an outboard trolling motor and a support structure attachable to the outboard drive unit through the drive unit's top cover for supporting the mounting block to one side of the drive unit at a location behind the boat's transom.

U.S. Pat. No. 5,116,267, which issued to Olson on May 26, 1992, describes a yieldable protective mount for trolling motors. The mounting mechanism incorporates a mounting base that is fixed to the deck structure or the stern structure of a small boat such as is typically used for recreational activities such as fishing. A motor support element is pivotally connected by hinge structure to the base and is continuously urged by tension springs to an operating position where the trolling motor is positioned for its normal operation.

U.S. Pat. No. 5,340,077, which issued to Tyler on Aug. 23, 1994, discloses a trolling motor anti-bounce mechanism. It allows fisherman to easily stow the trolling motor and control housing while assuring that damage to the mounting bracket, the trolling motor, and the control housing is minimized. The lower arm of the mounting bracket is secured to the boat. The upper arm of the mounting bracket forms a cantilever that projects from a pivot point. Stress forces will most likely cause metal fatigue to occur on the flange called the "positive stow lock feature" near the pivot point. Shock to the positive stow lock feature is minimized by provision of a rubber-based leg to stabilize the upper arm of the mounting bracket. The suspension of the trolling motor and the control housing limits their downward travel.

U.S. Pat. No. 6,224,437, which issued to Griffith et al. on May 1, 2001, describes a trolling motor mount stabilizer. The assembly includes a bracket adapted to support the trolling motor. A pivoting member, such as a link or an arm, has a first end pivotally coupled to the bracket. The pivoting member is also pivotally coupled to an abutment adjacent a boat deck or gunwale at its second end. A support member is rigidly affixed to a surface of the bracket such that the support member sustains the overhung load of the trolling motor while it is in the stowed position on the boat deck or gunwale. The support member is flat and unobtrusive when the motor is in its run position.

U.S. Pat. No. 6,254,441, which issued to Knight et al. on Jul. 3, 2001, describes a trolling motor propulsion unit support shaft. The system includes a lower propulsion unit, a mounting mechanism adapted to be coupled to the boat and a first shaft fitting at least partially between the mounting mechanism and the lower propulsion unit. The first shaft has a non-circular cross-sectional shape. In one embodiment, the mounting mechanism is configured to mount to a boat having a longitudinal axis extending from a bow to a stern of the boat, wherein the first shaft has a longitudinal length and smaller transverse width.

U.S. Pat. No. 6,394,408, which issued to Henderson et al. on May 28, 2002, discloses a trolling motor column mounting system. The trolling motor column is supported in a support frame by virtue of the ball and socket connection.

The column passes through the ball. The ball has a bore through which the column extends. The column may be secured in different positions to the bore or a tube which extends from the bore in the ball.

U.S. Pat. D461,480, which issued to Knight et al. on Aug. 13, 2002, describes a trolling motor propulsion unit support shaft.

U.S. Pat. No. 6,808,431, which issued to Neely on Oct. 26, 2004, describes a trolling motor mount tool. The tool is intended to assist in the moving of a trolling motor support mount between a lowered position and a raised position. The trolling motor mount tool includes a main member having a first cutout and a second cutout, a first arm pivotally attached to the main member, wherein the first arm includes an engaging tube, and a second arm pivotally attached to the main member having an arm cutout. The user utilizes the first cutout and an arm cutout to engage the locking pin of a motor mount for a trolling motor. The user utilizes the second cutout and the engaging tube of the first arm to engage the locking pin of the motor mount.

The patents described above are hereby expressly incorporated by reference in the description of the present invention.

When a trolling motor is in a stowed position, the extendable arm is typically supported, in a cantilever condition, slightly above the deck of the boat. As the boat moves in response to waves, or while on a trailer being towed by an automobile, impulses can cause the cantilever arm to move upwardly and downwardly relative to the surface of the boat deck. This can induce stress on the components of the trolling motor and, in certain instances, can cause annoying impact noises if the cantilevered arm of the trolling motor repeatedly strikes the deck surface. It would therefore be beneficial if a component could be provided that cushions and supports the extended retractable arm of the trolling motor in relation to the deck surface of a boat.

SUMMARY OF THE INVENTION

A support device for a trolling motor, in accordance with a preferred embodiment of the present invention, comprises a support pad shaped to extend across a width of an arm of a trolling motor, a first retention member attached to a first end of the support pad, and a second retention member attached to a second end of the support pad. The first and second retention members are configured to retain the support pad in position relative to the arm of the trolling motor.

The present invention can further comprise a first distal end extending from the first retention member and a second distal end extending from the second retention member. The first and second distal ends can both extend in overlapping relation over first and second portions, respectively, of the first and second retention members in order to define first and second gaps, respectively, therebetween. The first and second gaps can be shaped to receive first and second sidewalls of the arm of the trolling motor and, in certain preferred embodiments of the present invention, the first and second gaps can be tapered to decrease in dimension toward the termini of the first and second distal ends. At least one cavity can be formed in the support pad in order to increase its compressibility. The support pad can comprise an inner surface and an outer surface. The inner surface is configured to be in contact with the arm of the trolling motor when the support device is attached to the arm of the trolling motor. The outer surface faces away from the arm of the trolling motor. An expansion cavity is formed, in a particularly preferred embodiment of the present invention, in the support pad and configured to increase the deformability of the support pad. A cord retention slot can be formed in the support pad and shaped to retain a pull cord therein. An electrical cable retention slot can be formed in the support pad and shaped to retain a transducer cable therein.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
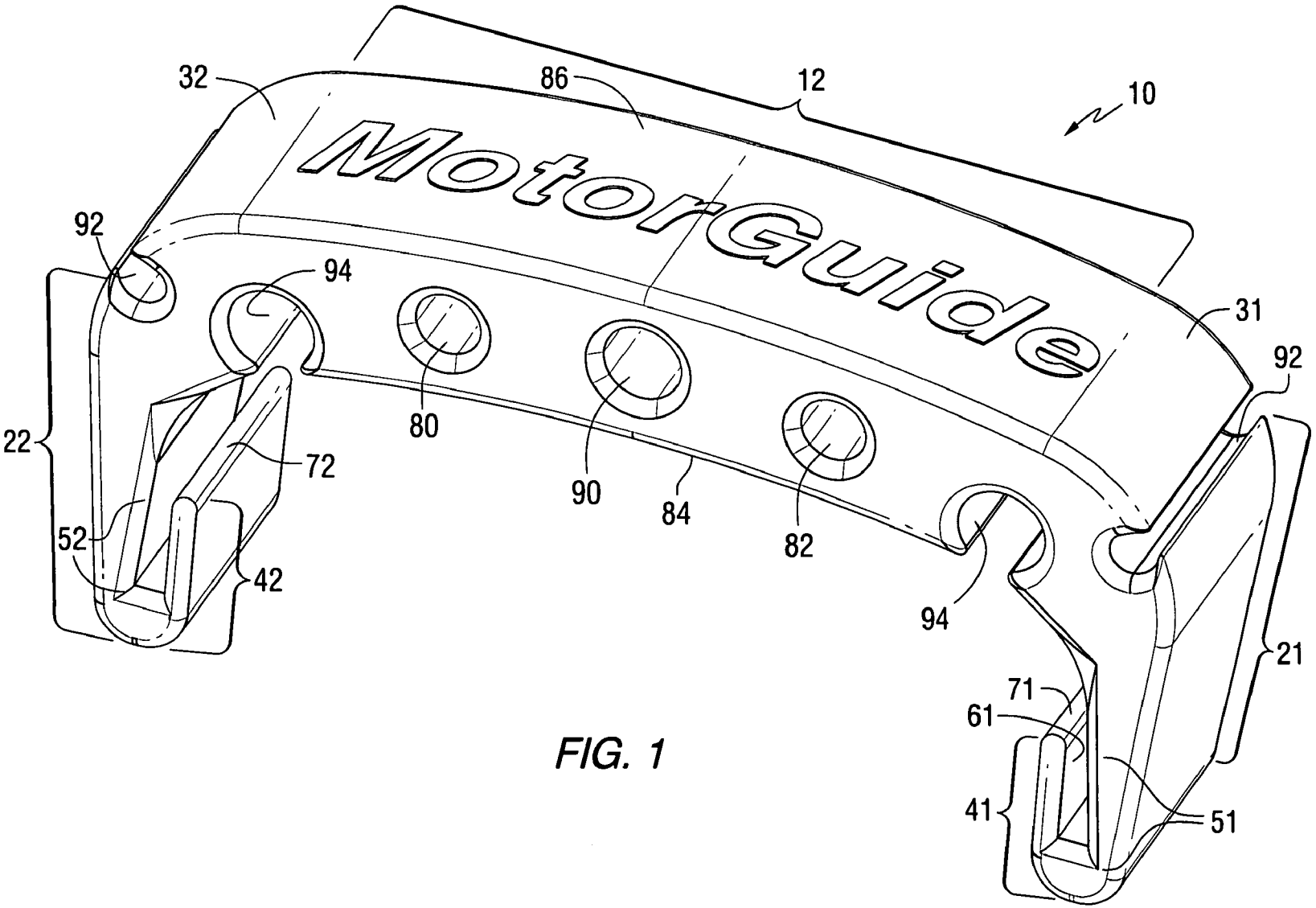
FIG. 1 is an isometric view of the support device of the present invention.

Throughout the description of the preferred embodiment of the present invention, like components will be identified by like reference numerals.

FIG. 1 shows the support device of a preferred embodiment of the present invention. It is intended to be attached to an arm of a trolling motor in a manner that will be described in greater detail below. The support device comprises a support pad 12 that is shaped to extend across a width of an arm of the trolling motor. A first retention member 21 and a second retention member 22 are attached to first and second ends, 31 and 32, of the support pad 12. The first and second retention members, 21 and 22, are configured to retain the support pad 12 in position relative to the arm of the trolling motor.

With continued reference to FIG. 1, a first distal end 41 and a second distal end 42 extend from the first and second retention members, 21 and 22. The first distal end 41 extends in overlapping relation over a first portion 51 of the first retention member 21. The second distal end 42 extends in overlapping relation over a second portion 52 of the second retention member 22. The first and second distal ends, 41 and 42, define first and second gaps, 61 and 62, therebetween. As will be described in greater detail below, the first and second gaps, 61 and 62, are shaped to receive first and second side walls of the arm of the trolling motor. In a particularly preferred embodiment of the present invention, the first and second gaps, 61 and 62, are tapered so that they decrease in dimension toward the termini, 71 and 72, of the first and second distal ends, 41 and 42.

With continued reference to FIG. 1, cavities, 80 and 82, are formed in the support pad 12 in order to decrease its compressibility when compressive forces are experienced against its inner surface 84 and its outer surface 86. The inner surface 84 is configured to be in contact with a surface of the arm of the trolling motor when the support device is attached to the arm. The outer surface 86 faces away from the arm of the trolling motor. An expansion cavity 90 is formed in the support pad 12 and configured to increase the deformability of the support pad 12. In other words, when the attachment 10 is attached to a trolling motor, the facing surfaces of the expansion cavity 90 can deform to facilitate installation on the arm of the trolling motor. A cord retention slot 92 is illustrated in FIG. 1 as being formed in the support pad 12, near the first end 31 of the support pad. It is shaped to receive a pull cord for a manual handle that allows the operator of a marine vessel to move the trolling motor from one position to another. Another cord retention slot 92 is shown at the second end 32 of the support pad 12 in order to provide optional locations where the operator of a marine vessel can store the cord. An electrical cable retention slot 94 is provided in the inner surface 84 of the support pad 12 at two locations as illustrated in FIG. 1. These electrical cable retention slots 94 are formed in the support pad and shaped to retain a transducer cable therein. The electrical cable retention slot 94 is provided at two locations to provide an option for the operator of the marine vessel.

Figure 2:
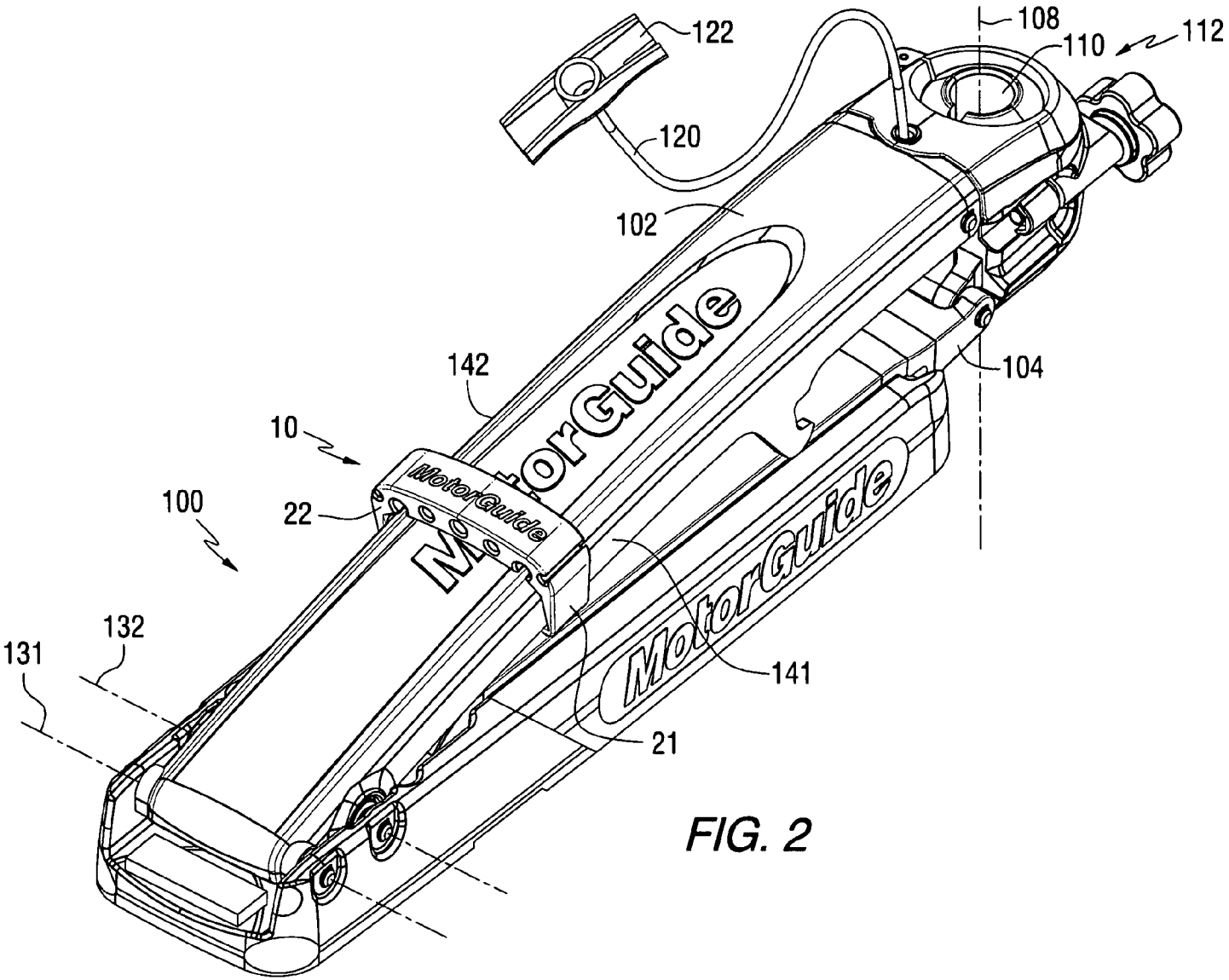
FIG. 2 shows the support device attached to a trolling motor mount which is in a deployed or operative position.

FIG. 2 illustrates a trolling motor 100 with its top and lower bow arms, 102 and 104, shown in a deployed position. Axis 108 illustrates a central axis of a support shaft (not shown in FIG. 2) that is associated with the trolling motor mount and which provides support for an electric motor that drives a propeller. In other words, in a manner well known to those skilled in the art, the shaft extends through the hole 110 and is supported by the head portion 112 of the trolling motor mount. Also shown in FIG. 2 is a pull cord 120 with a handle 122 attached to it. As described above, the pull cord assists the operator when the trolling motor 100 is moved from its deployed position, shown in FIG. 2, to its retracted or stowed position which will be described below.

With continued reference to FIG. 2, the axis 131 of the top bow arm 102 and the axis 132 of the lower bow arm 104 are also shown. These two axes provide the center of rotation of the top and lower bow arms, 102 and 104. Since the two axes, 131 and 132, are not coaxial with each other, the top and lower bow arms also move axially relative to each other as the trolling motor 100 is moved from its stowed position to its deployed position and vice versa.

The support device 10 of the present invention is shown attached to the top bow arm 102. Its first and second retention members, 21 and 22, are shown in association with the first and second side walls, 141 and 142, of the top bow arm 102.

Figure 3:
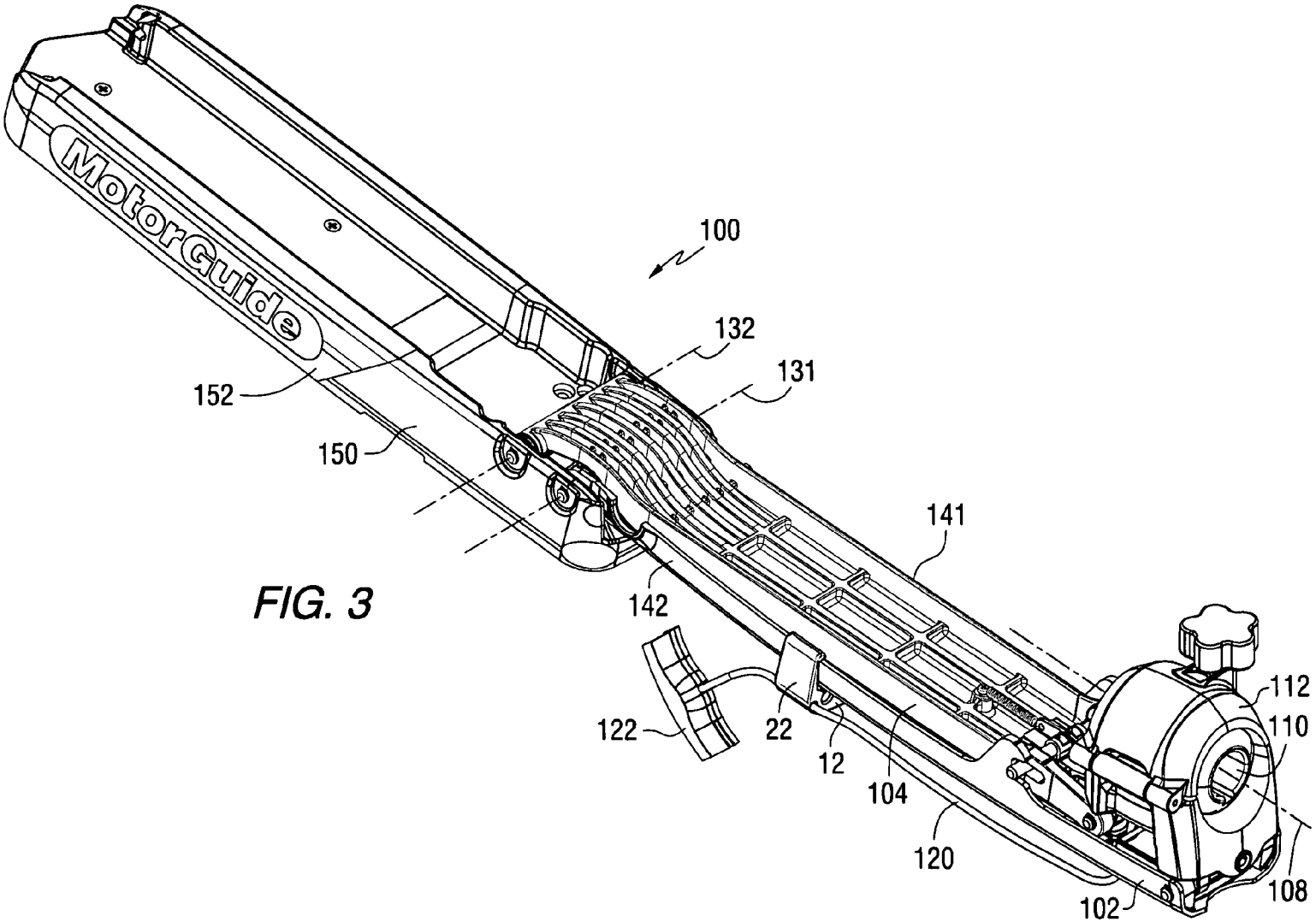
FIG. 3 shows the present invention attached to a trolling motor mount that is in a stowed position.

FIG. 3 shows the trolling motor 100 in its retracted or stowed position. The axis 108 of the support shaft for the trolling motor 100 is shown extended in a generally horizontal direction. The motor and propeller of the trolling motor assembly would be located in the upper right portion of FIG. 3.

With reference to FIGS. 2 and 3, other components of the trolling motor 100 will be identified. A base channel 150 is configured to be attached to the deck of a marine vessel. A molded decket 152 is shaped to be attached to the base channel 150. In a typical application, the molded decket 152 is made of a polymer material and the base channel 150 is made of aluminum. The pivot axes, 131 and 132, are shown in relation to the stowed position in FIG. 3. The displacement between these two axes results in an axial relative movement between the top bow arm 102 and the lower bow arm 104. The first retention member 21 is shown in relation to the first side wall 141 of the top bow arm 102. It should be understood that the second retention member 22 is similarly associated with the second side wall 142.

Figure 4:
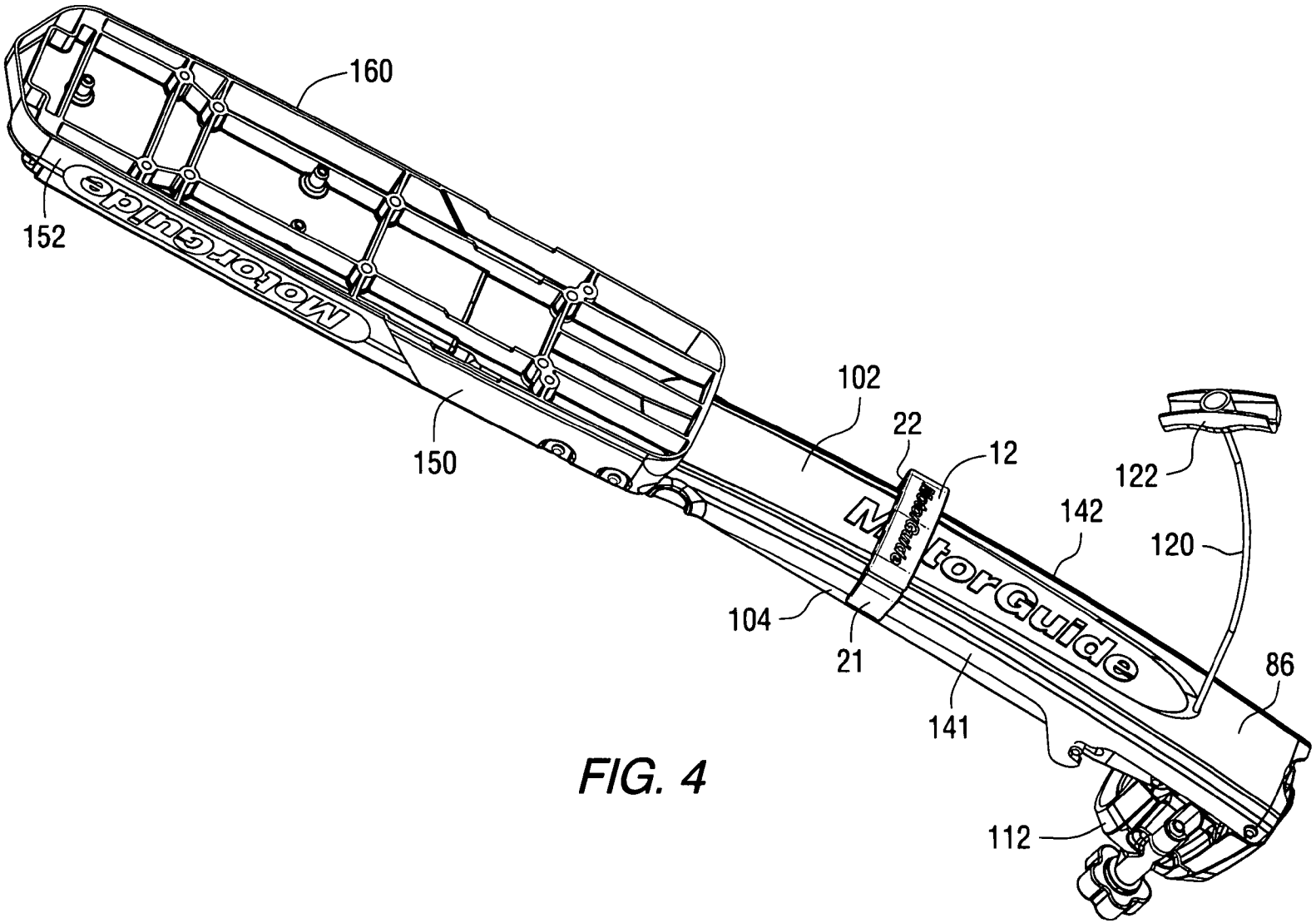
FIG. 4 is generally similar to FIG. 3, but showing an underside of the trolling motor mount.

FIG. 4 is generally similar to FIG. 3, but showing the underside of the device. In other words, the bottom portion 160 of the base channel 150 is configured to be placed against the deck surface of a boat when the base channel 150 is rigidly attached to the deck surface. The molded decket 152, which is typically made of a polymer material, is attached to the base channel 150. The top bow arm 102 is shown with the support pad 12 located over an upper surface 86 of the arm. The top bow arm 102 and the lower bow arm 104 are also shown in FIG. 4. The second retention member 22 is illustrated in FIG. 4 associated with the second side wall 142 of the top bow arm 102.

Figure 5:
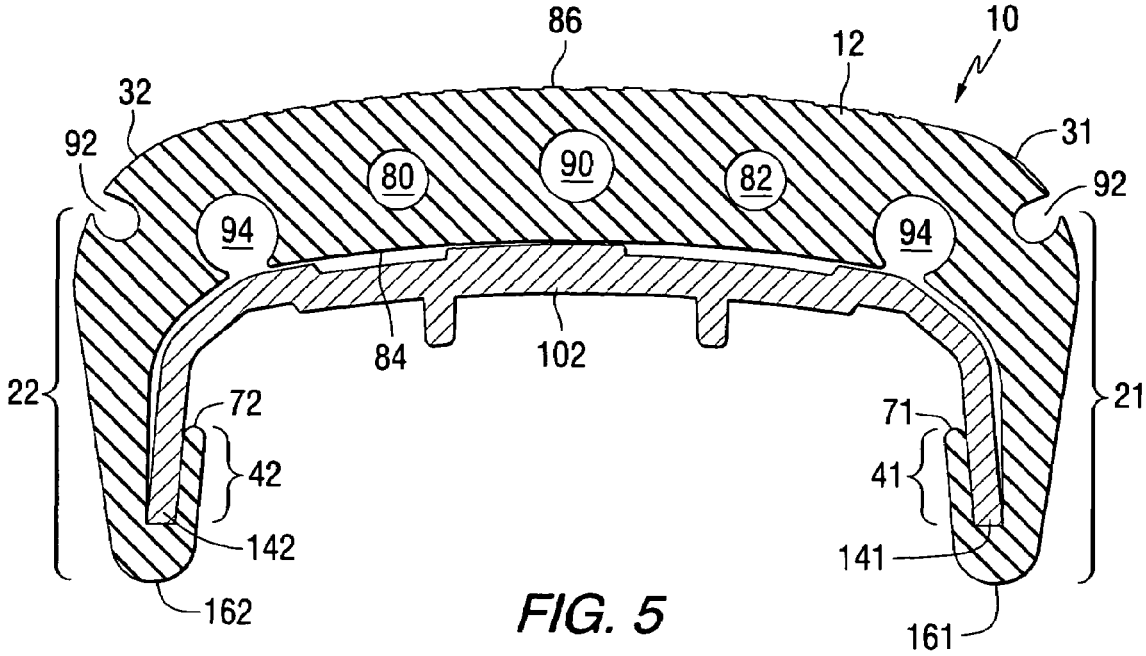
FIG. 5 is a section view taken through the support device of the present invention and through an arm of a trolling motor mount.

FIG. 5 is a section view showing the support device 10 of the present invention attached to a top bow arm 102 of a trolling motor, as described above in conjunction with FIGS. 2-4. The inner surface 84 of the attachment 10 is configured to be in contact with the arm 102 as illustrated. The outer surface 86 faces away from the arm 102. The support pad 12, or cushion, is illustrated at its operative position relative to the width of the arm 102. The first and second retention members, 21 and 22, or side members, are illustrated extending downwardly from the first and second ends, 31 and 32, of the cushion, or support pad 12. The first and second distal ends, 41 and 42, are shown in overlapping relation with the first and second portions, respectively, of the first and second retention members, 21 and 22. This relationship defines slots which are shaped to receive the first and second side walls, 141 and 142, therein. The presence of the side walls within the gaps retains the support device 10 in position relative to the arm of the trolling motor.

With continued reference to FIG. 5, the first and second distal ends, or catches, identified by reference numerals 41 and 42, serve to retain the support device 10 in position relative to the arm of the trolling motor without the need for individual fasteners. As described above, the termini, 71 and 72, are located closer to their respective retention member, 21 or 22, than the other portion of the first and second distal ends, 41 and 42. This results in a gap which decreases in width from the bends, 161 and 162, to the termini, 71 and 72. This decreasing dimension of the gaps, in a particularly preferred embodiment of the present invention, helps to grip the side walls, 141 and 142, and more effectively retain the support device 10 in position relative to the arm 102 of the trolling motor.

Figure 6:
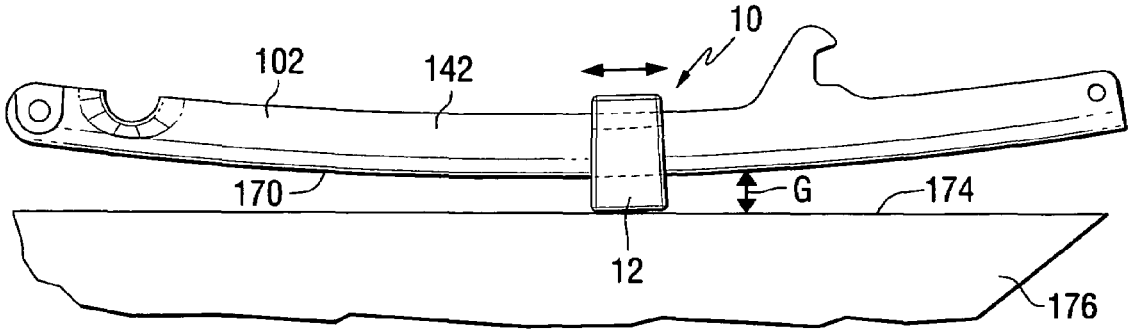
FIG. 6 is a side view of an arm of trolling motor mount shown in relation to a deck surface of a boat with the present invention providing a cushion therebetween.

FIG. 6 is a side view of a top bow arm 102 with a support device 10 of the present invention attached to it. The support pad 12, or cushion, is located between a surface 170 of the top bow arm 102 and a deck surface 174 of a boat 176. Without the support device 10 in place, a gap G would exist between the surface 170 of the top bow arm 102 and the deck surface 174. This gap G could allow the top bow arm 102 to bounce up and down in FIG. 6 in response to movement of the boat 176 over waves. Also, this bouncing of the top bow arm 102 could occur when the boat 176 is being trailered from one location to another over roads. As can be seen in FIG. 6, the support device 10 provides a cushion, or support pad 12, which inhibits this bouncing and prevents direct contact between the surface 170 of the top bow arm 102 and the deck surface 174 of the boat 176.

The present invention provides a support device for a trolling motor that is easily attachable to an arm of the trolling motor to provide a cushion between the arm and the deck of a boat. It is attachable without the need for additional components, such as clips or screws, at a variety of locations along the length of the arm of the trolling motor. A support pad 12, or cushion, is shaped to extend across a surface of the arm of the trolling motor, such as along its width. First and second retention members, 21 and 22, or side members, are attached to first and second ends, 31 and 32, respectively. These side members, or retention members, are configured to retain the cushion, or support pad 12, in position relative to the arm. First and second catches, or distal ends, extend in overlapping relation over associated portions of the first and second retention members, 21 and 22, respectively. This relationship defines first and second gaps that are shaped to receive first and second side walls, 141 and 142. Cavities, 80 and 82, can be provided to increase the compressibility of the support pad 12. In other words, these cavities formed in the support pad 12 can make it softer to improve the cushioning effect between the surface 170 of the top bow arm 102 and the deck surface 174 of a boat 176.

Although the present invention has been described in with particular specificity and illustrated to show a preferred embodiment, it should be understood that alternative embodiments are also within its scope.

I claim:

1. A support device for a trolling motor, comprising:

a support pad shaped to extend across a width of an arm of said trolling motor;

a first retention member attached to a first end of said support pad;

a second retention member attached to a second end of said support pad, said first and second retention members being configured to retain said support pad in position relative to said arm of said trolling motor;

a first distal end extending from said first retention member; and a second distal end extending from said second retention member, said first distal end extending in overlapping relation over a first portion of said first retention member to define a first gap therebetween, said second distal end extending in overlapping relation over a second portion of said second retention member to define a second gap therebetween.

2. The support device of claim 1, wherein:

said first and second gaps are shaped to receive first and second sidewalls of said arm of said trolling motor.

3. The support device of claim 1, wherein:

said first and second gaps are tapered to decrease in dimension toward the termini of said first and second distal ends.

4. The support device of claim 1, further comprising:

at least one cavity formed in said support pad to increase its compressibility.

5. The support device of claim 1, wherein:

said support pad comprises an inner surface and an outer surface, said inner surface being configured to be in contact with said arm of said trolling motor when said support device is attached to said arm of said trolling motor, said outer surface facing away from said arm of said trolling motor.

6. The support device of claim 5, further comprising:

an expansion cavity formed in said support pad and configured to increase the deformability of said support pad.

7. The support device of claim 5, further comprising:

a cord retention slot formed in said support pad and shaped to retain a pull cord therein.

8. The support device of claim 5, further comprising:

an electrical cable retention slot formed in said support pad and shaped to retain a transducer cable therein.

9. A support device for a trolling motor, comprising:

a cushion shaped to extend across a surface of an arm of said trolling motor;

a first side member attached to a first end of said cushion;

a second side member attached to a second end of said cushion, said first and second side members being configured to retain said cushion in position relative to said arm of said trolling motor, a first catch extending in overlapping relation over a first portion of said first side member to define a first gap therebetween, a second catch extending in overlapping relation over a second portion of said second side member to define a second gap therebetween, said first and second gaps being shaped to receive first and second sidewalls of said arm of said trolling motor.

10. The support device of claim 9, wherein:

said first and second gaps are tapered to decrease in dimension toward the termini of said first and second catches.

11. The support device of claim 10, further comprising:

said cushion comprises an inner surface and an outer surface, said inner surface being configured to be in contact with said arm of said trolling motor when said support device is attached to said arm of said trolling motor, said outer surface facing away from said arm of said trolling motor; and an expansion cavity formed in said cushion and configured to soften said cushion.

12. The support device of claim 9, further comprising:

a cable retention slot formed in said cushion and shaped to retain a cable.

13. A support device for a trolling motor, comprising:

a support pad shaped to extend across a surface of a support structure of said trolling motor;

a first retention member attached to a first end of said support pad;

a second retention member attached to a second end of said support pad, said first and second retention members being configured to retain said support pad in position relative to said support structure of said trolling motor;

a first distal end extending in overlapping relation over a first portion of said first retention member to define a first gap therebetween; and a second distal end extending in overlapping relation over a second portion of said second retention member to define a second gap therebetween.

14. The support device of claim 13, wherein:

said first and second gaps are shaped to receive first and second sidewalls of said support structure of said trolling motor.

15. The support device of claim 14, further comprising:

at least one cavity formed in said support pad to increase its compressibility.

16. The support device of claim 15, wherein:

said support pad comprises an inner surface and an outer surface, said inner surface being configured to be in contact with said support structure of said trolling motor when said support device is attached to said support structure of said trolling motor, said outer surface facing away from said support structure of said trolling motor, said support pad having an expansion cavity formed therein and configured to increase the deformability of said support pad.

* * * * *